US011443685B1

(12) United States Patent
Chien et al.

(10) Patent No.: US 11,443,685 B1
(45) Date of Patent: Sep. 13, 2022

(54) DISPLAY DEVICE, DRIVER CHIP, AND DISPLAYING METHOD

(71) Applicant: NOVATEK Microelectronics Corp., Hsinchu (TW)

(72) Inventors: Tso-Hua Chien, Taoyuan (TW); Huang-Chin Tang, Hsinchu County (TW)

(73) Assignee: NOVATEK Microelectronics Corp., Hsinchu (TW)

( * ) Notice: Subject to any disclaimer, the term of this patent is extended or adjusted under 35 U.S.C. 154(b) by 0 days.

(21) Appl. No.: 17/451,488

(22) Filed: Oct. 19, 2021

(30) Foreign Application Priority Data

Feb. 26, 2021 (TW) ..... 110202101

(51) Int. Cl.
*G09G 3/20* (2006.01)

(52) U.S. Cl.
CPC ..... *G09G 3/2096* (2013.01); *G09G 2310/0286* (2013.01); *G09G 2310/08* (2013.01); *G09G 2330/08* (2013.01)

(58) Field of Classification Search
CPC ..... G09G 3/2092; G09G 3/2096; G09G 2310/0286; G09G 2310/08; G09G 2330/08; G09G 2330/12
See application file for complete search history.

(56) References Cited

U.S. PATENT DOCUMENTS

| | | | | |
|---|---|---|---|---|
| 7,330,170 | B2 * | 2/2008 | Hwang | G09G 3/3648 345/212 |
| 9,589,664 | B2 * | 3/2017 | Lou | G09G 3/3674 |
| 10,726,755 | B2 * | 7/2020 | Liu | G09G 3/3677 |
| 10,777,121 | B1 * | 9/2020 | Liao | G09G 3/2092 |
| 11,017,702 | B2 * | 5/2021 | Jang | G09G 3/2092 |
| 2006/0227093 | A1 * | 10/2006 | Jang | G11C 19/28 345/100 |
| 2020/0090618 | A1 * | 3/2020 | Guo | G09G 3/36 |
| 2020/0090776 | A1 * | 3/2020 | Wang | G11C 19/287 |

* cited by examiner

*Primary Examiner* — Gene W Lee
(74) *Attorney, Agent, or Firm* — CKC & Partners Co., LLC

(57) ABSTRACT

A display device includes a processor circuit, a driver circuit, and a display panel. The driver circuit is coupled to the processor circuit to detect whether there is abnormal transmission between the processor circuit and the driver circuit. The display panel is coupled to the driver circuit. The display panel includes a display array and a shift register circuit. The display array is to display an image. The shift register circuit is coupled to the display array. When there is the abnormal transmission in a first display period of a first frame, the driver circuit outputs a control signal having a disable level in the first display period to the shift register circuit to control the shift register circuit not to operate in order to stop updating the image.

18 Claims, 6 Drawing Sheets

DISPLAY DEVICE, DRIVER CHIP, AND DISPLAYING METHOD

RELATED APPLICATIONS

This application claims priority to Taiwan Application Serial Number 110202101, filed Feb. 26, 2021, which is herein incorporated by reference.

BACKGROUND

Technical Field

The present disclosure relates to display technology. More particularly, the present disclosure relates to a display device, a driver chip, and a displaying method.

Description of Related Art

With developments of display technology, display panels are widely applied various electrical apparatuses. For example, the display panels can be applied to televisions, computers, cell phones, or wearable devices. These display panels can display image for users.

SUMMARY

Some aspects of the present disclosure are to provide a display device. The display device includes a processor circuit, a driver circuit, and a display panel. The driver circuit is coupled to the processor circuit to detect whether there is abnormal transmission between the processor circuit and the driver circuit. The display panel is coupled to the driver circuit. The display panel includes a display array and a shift register circuit. The display array is to display an image. The shift register circuit is coupled to the display array. When there is the abnormal transmission in a first display period of a first frame, the driver circuit outputs a control signal having a disable level in the first display period to the shift register circuit to control the shift register circuit not to operate in order to stop updating the image.

Some aspects of the present disclosure are to provide a driver chip. The driver chip includes a driver circuit and a first pin. The driver circuit is to detect whether there is abnormal transmission between the driver circuit and a processor circuit in a display device. The driver circuit is to output a control signal to a shift register circuit in the display device through the first pin. When there is the abnormal transmission in a first display period of a first frame, the control signal includes a disable level in the first display period to control the shift register circuit not to operate.

Some aspects of the present disclosure are to provide a displaying method. The displaying method includes following operations: detecting, by a driver circuit, whether there is abnormal transmission between a processor circuit and the driver circuit; and when there is the abnormal transmission in a first display period of a first frame, outputting, by the driver circuit, a control signal to a shift register circuit, wherein the control signal includes a disable level in the first display period to control the shift register circuit not to operate in order to stop updating an image on a display array.

BRIEF DESCRIPTION OF THE DRAWINGS

The disclosure can be more fully understood by reading the following detailed description of the embodiment, with reference made to the accompanying drawings as follows.

DETAILED DESCRIPTION

In the present disclosure, "connected" or "coupled" may refer to "electrically connected" or "electrically coupled." "Connected" or "coupled" may also refer to operations or actions between two or more elements.

Figure 1A:
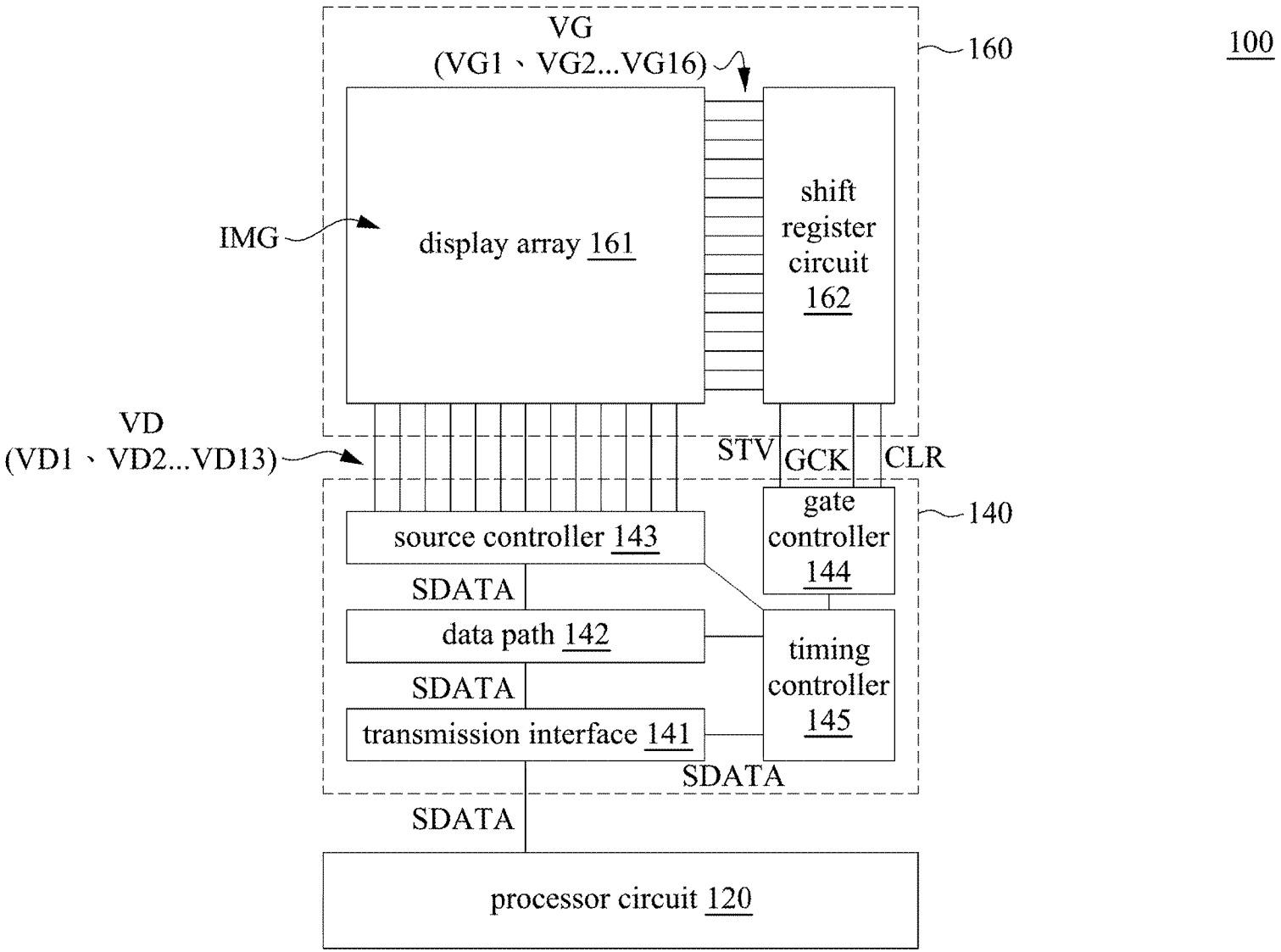
FIG. 1A is a schematic diagram illustrating a display device according to some embodiments of the present disclosure.

Reference is made to FIG. 1A. FIG. 1A is a schematic diagram illustrating a display device 100 according to some embodiments of the present disclosure. In some embodiments, the display device 100 can be applied to a TV, a computer, a cell phone, or a wearable device, but the present disclosure is not limited thereto.

As illustrated in FIG. 1A, the display device 100 includes a processor circuit 120, a driver circuit 140, and a display panel 160. The processor circuit 120 is coupled to the driver circuit 140. The driver circuit 140 is coupled to the display panel 160.

The processor circuit 120 can control the display panel 160 to display a image IMG through the driver circuit 140. In some embodiments, the processor circuit 120 is implemented by an application processor, but the present disclosure is not limited thereto.

The driver circuit 140 includes a transmission interface 141, a data path 142, a source controller 143, a gate controller 144, and a timing controller (TCON) 145. The transmission interface 141 is coupled to the processor circuit 120, the data path 142, and the timing controller 145. The data path 142 is coupled to the source controller 143. The timing controller 145 is coupled to the source controller 143 and the gate controller 144.

The display panel 160 includes a display array 161 and a shift register circuit 162. The display array 161 includes a plurality of sub-pixels. The source controller 143 is coupled the display array 161 through a plurality of data lines, in which each of the data lines is coupled to one column of the sub-pixels in the display array 161. The shift register circuit 162 is coupled to the display array 161 through a plurality of scan lines, in which each of the scan lines is coupled to one row of the sub-pixels in the display array 161. The gate controller 144 is coupled to the shift register circuit 162.

Regarding operations, the processor circuit 120 can transmit image data SDATA to the transmission interface 141 according to a transmission protocol. In some embodiments, the transmission interface 141 is a Mobile Industry Processor Interface (MIPI). In these embodiments, the processor circuit 120 can transmit the image data SDATA to the transmission interface 141 by MIPI protocol.

It is noted that the present disclosure is not limited to MIPI and the transmission protocol discussed above, and various suitable interfaces and transmission protocol are within the contemplated scopes of the present disclosure.

When the transmission interface 141 receives the image data SDATA from the processor circuit 120, the transmission interface 141 can output the image data SDATA to the source controller 143 through the data path 142, and output the image data SDATA to the timing controller 145. The timing controller 145 can control the source controller 143 and the gate controller 144 according to the received image data SDATA.

For example, the timing controller 145 can control the gate controller 144 to output a start-up signal STV, one or more gate clock signals GCK (FIG. 1A illustrates multiple gate clock signals GCK), and a control signal CLR to the shift register circuit 162. The start-up signal STV can start the shift register circuit 162. In general, the shift register circuit 162 includes shifter registers with multi-stages. These shifter registers operate stage by stage according to the gate clock signals GCK to generate a plurality of gate signals VG. These gate signals VG can be outputted to the display array 161 through the scan lines between the shift register circuit 162 and the display array 161. As illustrated in FIG. 1A, when there are 16 scan lines between the shift register circuit 162 and the display array 161, the gate signals VG generated by the shift register circuit 162 include gate signals VG1-VG16, in which the gate signal VG1 can be outputted to the sub-pixels in the first row through the first scan line, the gate signal VG2 can be outputted to the sub-pixels in the second row through the second scan line, and so on.

In addition, the timing controller 145 can control the source controller 143 to output one or more data signals VD according to the image data SDATA (FIG. 1A illustrates multiple data signals VD). These data signals VD can be outputted to the display array 161 through the data lines between the source controller 143 and the display array 161. As illustrated in FIG. 1A, when there are 13 data lines between the source controller 143 and the display array 161, the data signals VD generated by the source controller 143 include data signals VD1-VD13, in which the data signal VD1 can be outputted to the sub-pixels in the first column through the first data line, the data signal VD2 can be outputted to the sub-pixels in the second column through the second data line, and so on.

Then, the display array 161 can display the image IMG according to the gate signals VG and the data signals VD. For example, each sub-pixel in the display array 161 corresponds to a driving transistor. Each driving transistor can be turned on according to a corresponding gate signal VG. Then, this sub-pixel (such as but not limited to liquid crystal capacitors) can be charged to a corresponding voltage level according to a corresponding data signal VD such that this sub-pixel can display a corresponding grey-level. Based on similar operation principles, all sub-pixels in the display panel 161 can operate together to display the image IMG.

However, when interference or an electrostatic discharge (ESD) event occurs on the display panel 160, it will cause abnormal transmission between the processor circuit 120 and the driver circuit 140. The driver circuit 140 can detect whether there is the abnormal transmission. When the driver circuit 140 detects that there is the abnormal transmission between the processor circuit 120 and the driver circuit 140, the driver circuit 140 can output the control signal CLR with a disable level to the shift register circuit 162 to control the shift register circuit 162 not to operate. When the shift register circuit 162 does not operate, the image IMG on the display array 161 is not updated.

Figure 1B:
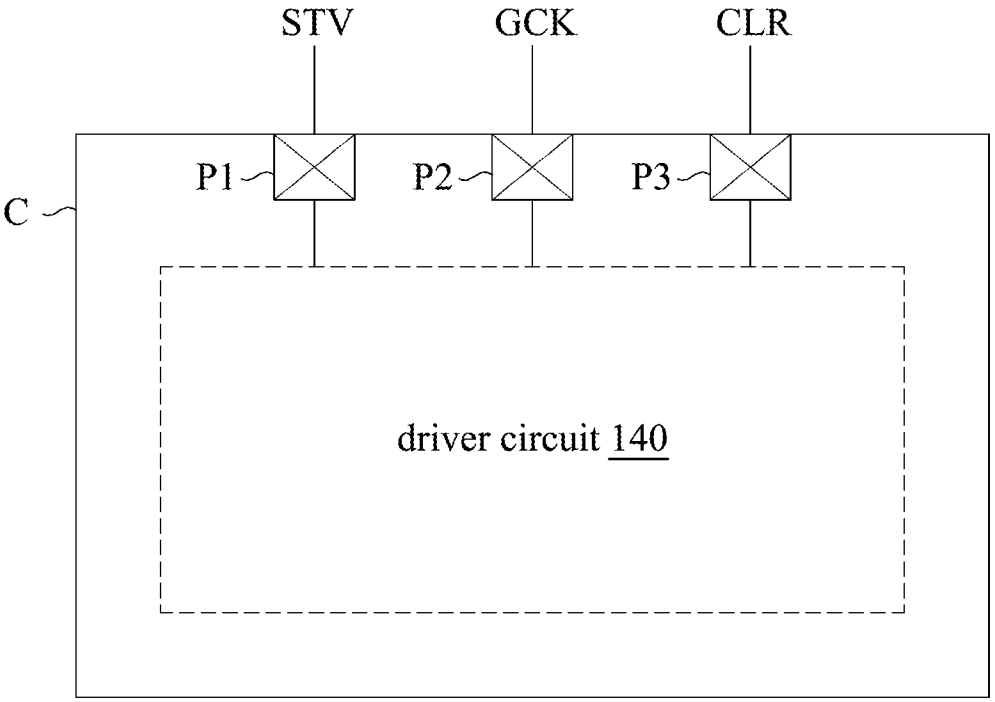
FIG. 1B is a schematic diagram illustrating a driver chip according to some embodiments of the present disclosure.

References are made to FIG. 1A and FIG. 1B. FIG. 1B is a schematic diagram illustrating a driver chip C according to some embodiments of the present disclosure. The driver chip C includes the driver circuit 140 in FIG. 1A and pins P1-P3. The gate controller 144 of the driver circuit 140 can output the start-up signal STV through the pin P1, output the gate clock signals GCK through the pin P2, and output the control signal CLR through the pin P3.

In some embodiments, the driver chip C can include more pins to output other signals (e.g., the data signals VD illustrated in FIG. 1A).

Figure 2:
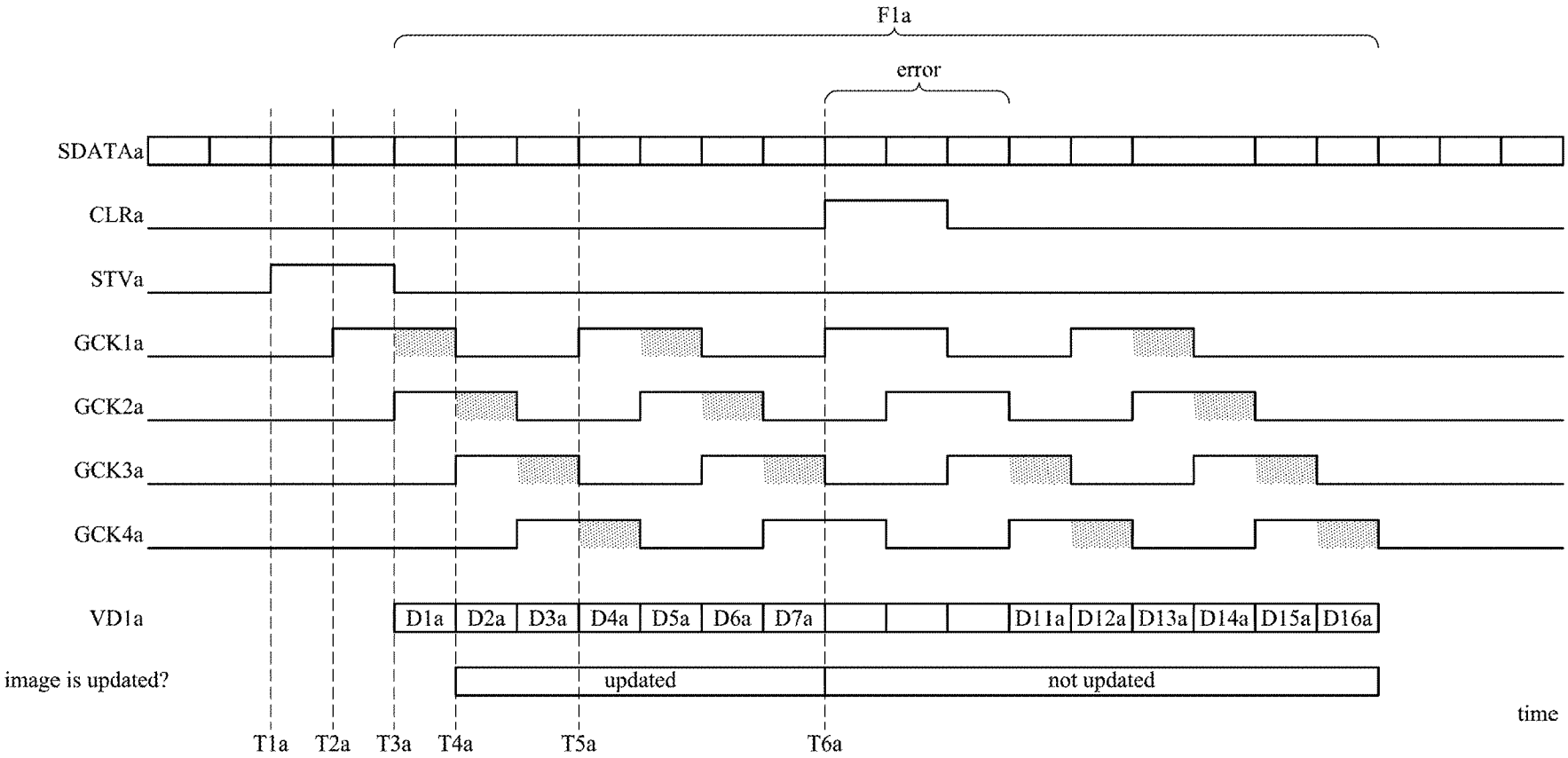
FIG. 2 is a waveform diagram illustrating signals of a display device according to some embodiments of the present disclosure.

References are made to FIG. 1A and FIG. 2. FIG. 2 is a waveform diagram illustrating signals of the display device 100 according to some embodiments of the present disclosure.

For better understanding, only a data signal VD1*a* (corresponding to image data SDATAa) on the first data line is illustrated in FIG. 2, and the data signals on other data lines are omitted. Thus, following paragraphs merely describe the sub-pixels in the first column, in which these sub-pixels are coupled to the first data line.

As illustrated in FIG. 2, the data signal VD1*a* includes data D1*a*-D16*a* in a display period of a frame F1*a*.

At a timing point T1*a*, a start-up signal STVa changes from a disable level to an enable level. The disable level of the start-up signal STVa is, for example, a logic value of 0, the enable level of the start-up signal STVa is, for example, a logic value of 1, but the present disclosure is not limited thereto. As described above, when the start-up signal STVa has the enable level, the start-up signal STVa can start the shift register circuit 162.

At a timing point T2*a*, a gate clock signal GCK1*a* changes from a disable level to an enable level. The disable level of the gate clock signal GCK1*a* is, for example, a logic value of 0, the enable level of the gate clock signal GCK1*a* is, for example, a logic value of 1, but the present disclosure is not limited thereto. When the gate clock signal GCK1*a* has the enable level, the shift register of the first stage in the shift register circuit 162 can output a gate signal VG1 with an enable level to the first scan line according to the gate clock signal GCK1*a* to turn on the driving transistors of the sub-pixels in the first row. The source controller 143 can charge these driving transistors at a timing point T3*a* according to the data D1*a*. Accordingly, the sub-pixel at the first column and at the first row can display a grey-level corresponding to the data D1*a*.

Similarly, at the timing point T3*a*, a gate clock signal GCK2*a* changes from a disable level to an enable level. The disable level of the gate clock signal GCK2*a* is, for example, a logic value of 0, the enable level of the gate clock signal GCK2*a* is, for example, a logic value of 1, but the present disclosure is not limited thereto. When the gate clock signal GCK2*a* has the enable level, the shift register of the second stage in the shift register circuit 162 can output a gate signal VG2 with an enable level to the second scan line according to the gate clock signal GCK2*a* to turn on the driving transistors of the sub-pixels in the second row. The source controller 143 can charge these driving transistors at a timing point T4*a* according to the data D2*a*. Accordingly, the sub-pixel at the first column and at the second row can display a grey-level corresponding to the data D2*a*.

Then, a gate clock signal GCK3*a* and a gate clock signal GCK4*a* have enable levels sequentially. Based on similar operation principles, the sub-pixel at the first column and at the third row can display a grey-level corresponding to the data D3*a*, and the sub-pixel at the first column and at the fourth row can display a grey-level corresponding to the data D4*a*.

At a timing point T5*a*, the gate clock signal GCK1*a* has the enable level again. In this situation, the shift register of the fifth stage in the shift register circuit 162 can output a gate signal with an enable level to the fifth scan line according to the gate clock signal GCK1*a* to turn on the driving transistors of the sub-pixels in the fifth row. Accordingly, the sub-pixel at the first column and at the fifth row can display a grey-level corresponding to the data D5*a*.

Then, the gate clock signal GCK2*a* and the gate clock signal GCK3*a* have enable levels again sequentially. Based on similar operation principles, the sub-pixel at the first column and at the sixth row can display a grey-level corresponding to the data D6*a*, and the sub-pixel at the first column and at the seventh row can display a grey-level corresponding to the data D7*a*.

However, when the interference or the ESD event occurs on the display panel 160 at an error timing point T6*a*, it will cause abnormal transmission between the processor circuit 120 and the driver circuit 140. As illustrated in FIG. 2, since the display panel 160 has an error in the display period of the frame F1*a*, the driver circuit 140 outputs a control signal CLRa with a disable level to the shift register circuit 162 in the display period of the frame F1*a* to control the shift register circuit 162 not to operate. The disable level of the control signal CLRa is, for example, a logic value of 1, but the present disclosure is not limited thereto. When the shift register circuit 162 does not operate, the gate signals VG cannot turn on the driving transistors of those sub-pixels. Accordingly, the image IMG on the display array 161 cannot be updated. Since the image IMG is not updated, it can prevent the display array 161 from displaying wrong images.

In FIG. 2, the gate clock signals GCK1*a*-GCK4*a* are normal after the error timing point T6*a*. In other words, each of the gate clock signals GCK1*a*-GCK4*a* has the enable level and the disable level after the error timing point T6*a*. However, since the shift register circuit 162 does not operate, the image IMG on the display array 161 cannot be updated after the error timing point T6*a*.

Figure 3:
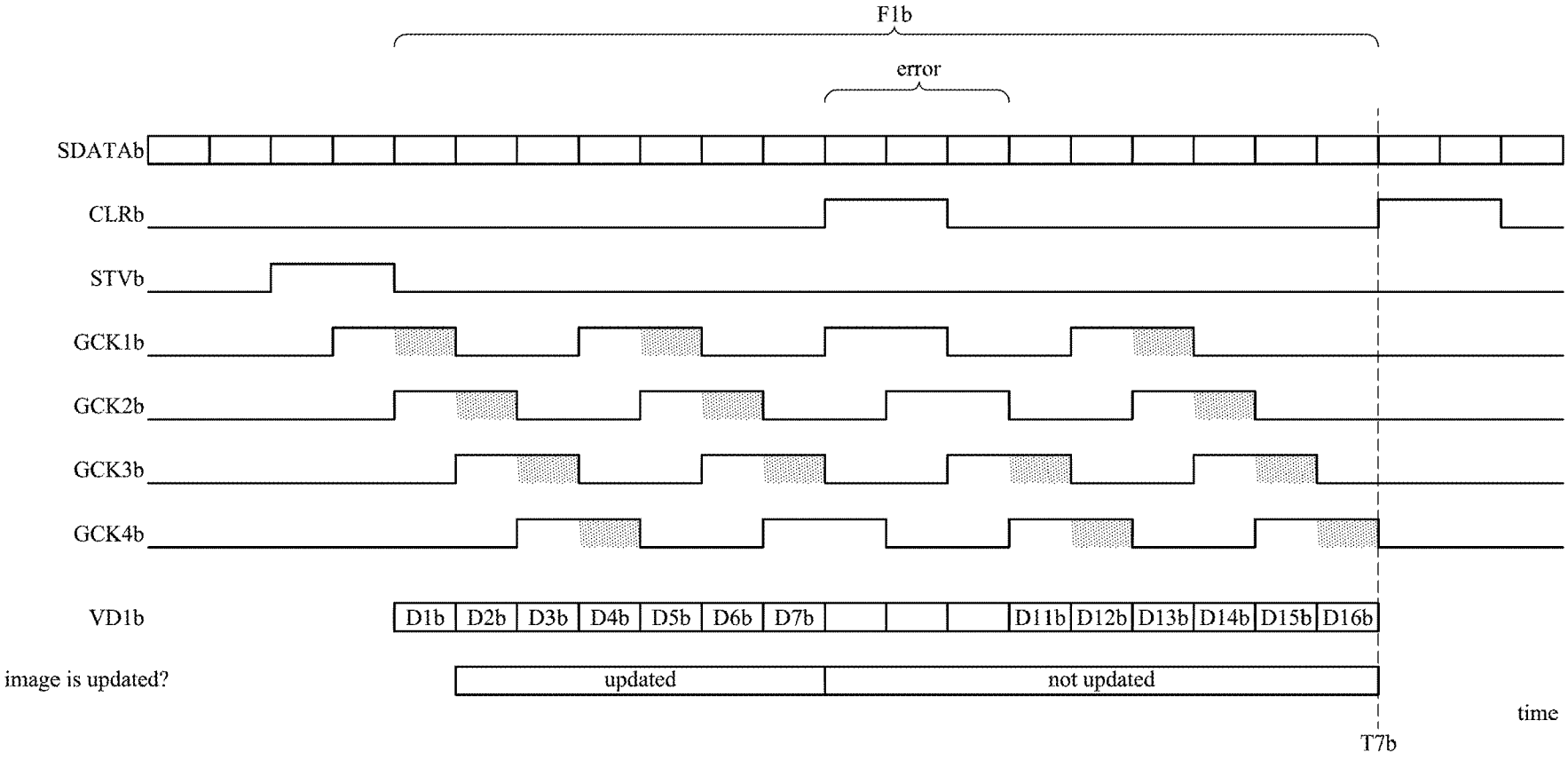
FIG. 3 is a waveform diagram illustrating signals of a display device according to some embodiments of the present disclosure.

References are made to FIG. 1A and FIG. 3. FIG. 3 is a waveform diagram illustrating signals of the display device 100 according to some embodiments of the present disclosure.

Image data SDATAb in FIG. 3 is similar to the image data SDATAa in FIG. 2. Gate clock signals GCK1*b*-GCK4*b* in FIG. 3 are similar to the gate clock signals GCK1*a*-GCK4*a* in FIG. 2. A data signal VD1*b* in FIG. 3 is similar to the data signal VD1*a* in FIG. 2. Data D1*b*-D16*b* (included in a display period of a frame F1*b*) in FIG. 3 is similar to the data D1*a*-D16*a* (included in the display period of the frame F1*a*) in FIG. 2.

A major difference between FIG. 3 and FIG. 2 is that a control signal CLRb in FIG. 3 has a disable level between the display period of a frame F1*b* and a display period of a next frame. Similar to the control signal CLRa in FIG. 2, the disable level of the control signal CLRb in FIG. 3 is, for example, a logic value of 1, an enable level of the control signal CLRb is, for example, a logic value of 0, but the present disclosure is not limited thereto. As illustrated in FIG. 3, the control signal CLRb changes from the enable level to the disable level at a timing point T7*b*. Accordingly, the control signal CLRb can control the shift register circuit 162 not to operate between two adjacent display periods. Then, when it enters into the display period of the next frame, a start-up signal STVb can have an enable level again to control the shift register circuit 162 to operate again.

Figure 4:
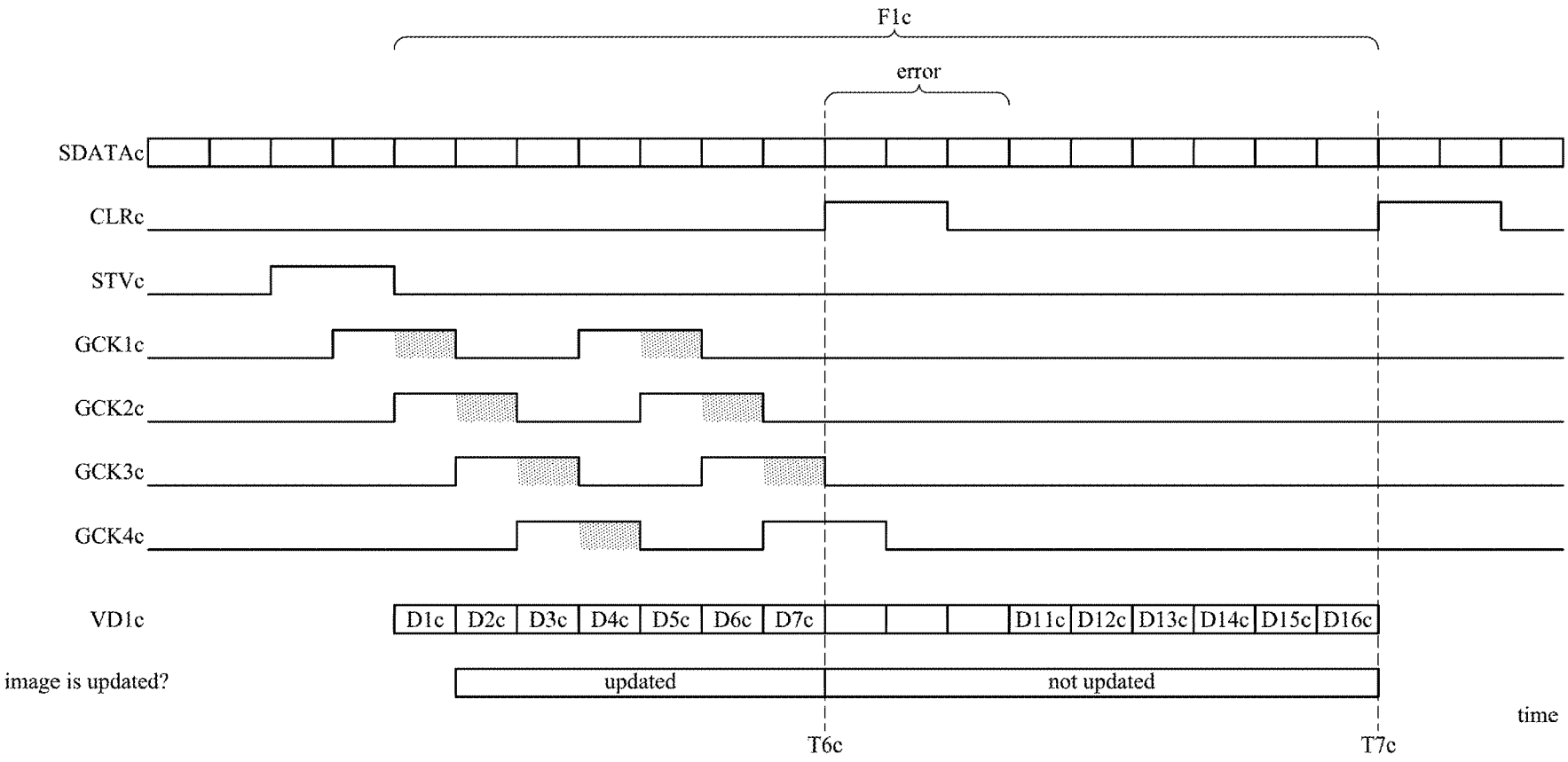
FIG. 4 is a waveform diagram illustrating signals of a display device according to some embodiments of the present disclosure.

References are made to FIG. 1A and FIG. 4. FIG. 4 is a waveform diagram illustrating signals of the display device 100 according to some embodiments of the present disclosure.

Image data SDATAc in FIG. 4 is similar to the image data SDATAb in FIG. 3. A control signal CLRc in FIG. 4 is similar to the control signal CLRb in FIG. 3. A data signal VD1*c* in FIG. 4 is similar to the data signal VD1*b* in FIG. 3. Data D1*c*-D16*c* (included in a display period of a frame F1*c*) in FIG. 4 is similar to the data D1*b*-D16*b* (included in the display period of the frame F1*b*) in FIG. 3.

A first difference between FIG. 4 and FIG. 3 is that gate clock signals GCK1*c*-GCK3*c* in FIG. 4 have disable levels (e.g., a logic value of 0) after an error timing point T6*c*. A second difference between FIG. 4 and FIG. 3 is that a gate clock signal GCK4*c* is kept to have a disable level when it is restored to the disable level.

Similar to FIG. 3, the control signal CLRc in FIG. 4 has a disable level (e.g., a logic value of 1) between the display period of the frame F1*c* and a display period of a next frame. As illustrated in FIG. 4, the control signal CLRc changes from an enable level to a disable level at a timing point T7*c*. Accordingly, the control signal CLRc can control the shift register circuit 162 not to operate between two adjacent display periods. Then, when it enters into the display period of the next frame, a start-up signal STVc can have an enable level again to control the shift register circuit 162 to operate again.

Reference is made to FIG. 1A again. In some other embodiments, the shift register circuit 162 can be implemented by two sets of shifter registers with multi-stages. One set is disposed at a first side of the display array 161 (e.g., a right-hand side on the figure), and the other is disposed at a second side of the display array 161 (e.g., a left-hand side on the figure) to implement a dual driving structure.

Figure 5:
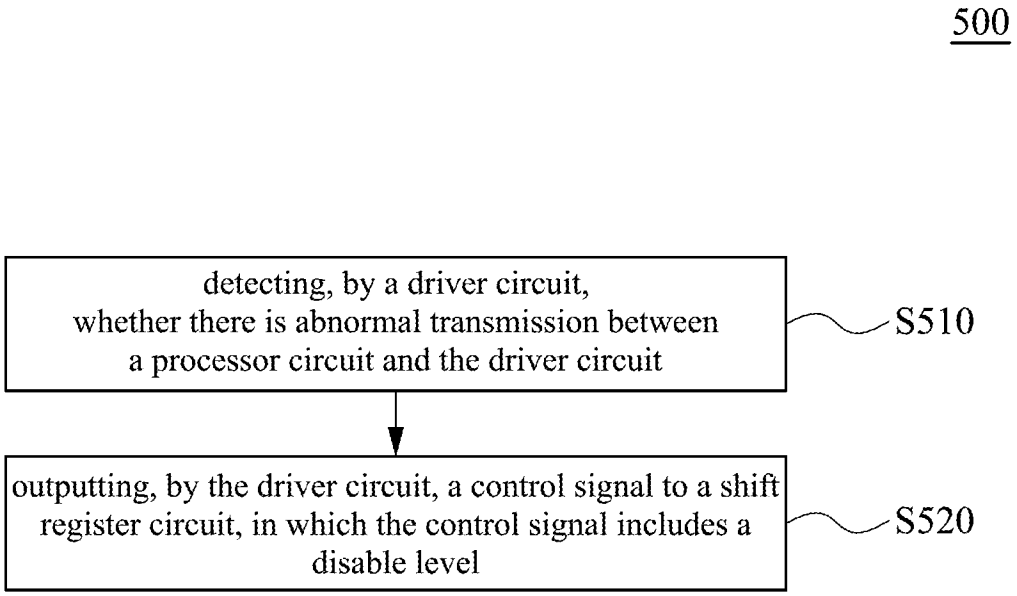
FIG. 5 is a flow diagram illustrating a display method according to some embodiments of the present disclosure.

Reference is made to FIG. 5. FIG. 5 is a flow diagram illustrating a display method 500 according to some embodiments of the present disclosure. In some embodiments, the display method 500 is applied to the display device 100 in FIG. 1A. As illustrated in FIG. 5, the display method 500 includes operations S510 and S520. The display method 500 is described in following paragraphs with reference to FIG. 1A.

In operation S510, the driver circuit 140 detect whether there is abnormal transmission between the processor circuit 120 and the driver circuit 140.

In operation S520, when the driver circuit 140 detects that there is the abnormal transmission between the processor circuit 120 and the driver circuit 140, the driver circuit 140 outputs the control signal CLR to the shift register circuit 162, in which the control signal CLR includes the disable level to control the shift register circuit 162 not to operate. Accordingly, the image IMG on the display array 161 is not updated.

Based on the descriptions above, the driver circuit of the present disclosure can control the shift register circuit not to operate when there is the abnormal transmission in order to stop updating the image on the display panel.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A display device, comprising:

a processor circuit;

a driver circuit coupled to the processor circuit to detect whether there is abnormal transmission between the processor circuit and the driver circuit; and a display panel coupled to the driver circuit and comprising:

a display array to display an image; and a shift register circuit coupled to the display array, wherein when there is the abnormal transmission in a first display period of a first frame, the driver circuit outputs a control signal having a disable level in the first display period to the shift register circuit to control the shift register circuit not to operate in order to stop updating the image, wherein the driver circuit comprises:

a gate controller coupled to the shift register circuit to output the control signal to the shift register circuit; and a timing controller coupled to the gate controller to control the gate controller.

2. The display device of claim 1, wherein the gate controller is further to output a gate dock signal to the shift register circuit, wherein after an error timing point, the gate dock signal comprises an enable level and a disable level.

3. The display device of claim 1, wherein the gate controller is further to output a gate dock signal to the shift register circuit, wherein after an error timing point, a level of the gate dock signal is a disable level.

4. The display device of claim 1, wherein the driver circuit further comprises:

a transmission interface coupled to the processor circuit to receive image data from the processor circuit; and a source controller coupled to the display array to output a data signal to the display array according to the image data.

5. The display device of claim 1, wherein the control signal comprises a disable level between the first display period and a second display period of a second frame to control the shift register circuit not to operate.

6. The display device of claim 5, wherein the driver circuit is further to control the shift register circuit to operate again in the second display period.

7. A driver chip, comprising:

a driver circuit to detect whether there is abnormal transmission between the driver circuit and a processor circuit in a display device; and a first pin, wherein the driver circuit is to output a control signal to a shift register circuit in the display device through the first pin, wherein when there is the abnormal transmission in a first display period of a first frame, the control signal comprises a disable level in the first display period to control the shift register circuit not to operate, wherein the driver circuit comprises:

a gate controller coupled to the shift register circuit to output the control signal to the shift register circuit through the first pin; and a timing controller coupled to the gate controller to control the gate controller.

8. The driver chip of claim 7, wherein the driver chip further comprises:

a second pin, wherein the gate controller is further to output a gate dock signal to the shift register circuit through the second pin, wherein after an error timing point, the gate dock signal comprises an enable level and a disable level.

9. The driver chip of claim 7, wherein the driver chip further comprises:

a second pin, wherein the gate controller is further to output a gate dock signal to the shift register circuit through the second pin, wherein after an error timing point, a level of the gate dock signal is a disable level.

10. The driver chip of claim 7, wherein the driver circuit further comprises:

a transmission interface to receive image data from the processor circuit; and a source controller to output a data signal to the display device according to the image data.

11. The driver chip of claim 7, wherein the control signal comprises a disable level between the first display period and a second display period of a second frame to control the shift register circuit not to operate.

12. The driver chip of claim 11, wherein the driver circuit is further to control the shift register circuit to operate again in the second display period.

13. A displaying method, comprising:

detecting, by a driver circuit, whether there is abnormal transmission between a processor circuit and the driver circuit;

controlling, by a timing controller of the driver circuit, a gate controller of the driver circuit; and when there is the abnormal transmission in a first display period of a first frame, outputting, by the gate controller of the driver circuit, a control signal to a shift register circuit, wherein the control signal comprises a disable level in the first display period to control the shift register circuit not to operate in order to stop updating an image on a display array.

14. The displaying method of claim 13, further comprising:

outputting, by the gate controller of the driver circuit, a gate dock signal to the shift register circuit, wherein after an error timing point, the gate dock signal comprises an enable level and a disable level.

15. The displaying method of claim 13, further comprising:

outputting, by the gate controller of the driver circuit, a gate dock signal to the shift register circuit, wherein after an error timing point, a level of the gate dock signal is a disable level.

16. The displaying method of claim 13, further comprising:

receiving, by a transmission interface of the driver circuit, image data from the processor circuit; and outputting, by a source controller of the driver circuit, a data signal to the display array according to the image data.

17. The displaying method of claim 13, wherein the control signal comprises a disable level between the first display period and a second display period of a second frame to control the shift register circuit not to operate.

18. The displaying method of claim 17, further comprising:

controlling, by the driver circuit, the shift register circuit to operate again in the second display period.

* * * * *